United States Patent [19]

Kawaguchi et al.

[11] 4,174,464

[45] Nov. 13, 1979

[54] ROD-TYPE INSULATOR HAVING IMPROVED WITHSTAND VOLTAGE CHARACTERISTICS UNDER A CONTAMINATED CONDITION

[75] Inventors: Toshiyuki Kawaguchi, Inuyama; Tomio Hayashi, Gifu, both of Japan

[73] Assignee: NGK Insulators, Ltd., Nagoya, Japan

[21] Appl. No.: 897,103

[22] Filed: Apr. 17, 1978

[30] Foreign Application Priority Data

Apr. 28, 1977 [JP] Japan ..... 52-49402

[51] Int. Cl.[2] ..... H01B 17/56

[52] U.S. Cl. ..... 174/212; 174/211

[58] Field of Search ..... 174/211, 212

[56] References Cited

U.S. PATENT DOCUMENTS 3,522,366 7/1970 Lambeth ..... 174/212

FOREIGN PATENT DOCUMENTS 1560920 2/1969 France ..... 174/212

*Primary Examiner*—Laramie E. Askin

*Attorney, Agent, or Firm*—Norbert P. Holler

[57] ABSTRACT

A rod-type insulator is provided with the optimum withstand voltage characteristics under a contaminated condition by selecting the ratio of the leakage distance per shed to the shed pitch to be between 3.8 and 5.0 and also selecting $4.5 \leqq l/p \leqq 6.0$, where p is the distance between the adjoining sheds, i.e., the distance between a given point on the lower surface of one shed and another given point on the upper surface of the other opposing shed, and l is the leakage distance between the two points.

8 Claims, 5 Drawing Figures

ROD-TYPE INSULATOR HAVING IMPROVED WITHSTAND VOLTAGE CHARACTERISTICS UNDER A CONTAMINATED CONDITION

BACKGROUND OF THE INVENTION

1. Field of the Invention

The present invention relates to rod-type or cylindrical insulators, such as, long-rod insulators for transmission line, station post insulators for power transformation and bushing shells.

2. Description of the Prior Art

The surface of insulators used with electric power equipment for electrical insulation purposes is subject to contamination with electrolytes, such as, sea salt, industrial contaminants and the like. Consequently the dielectric strength of the leakage surface of such a contaminated insulator will be decreased if it is subjected to wetting by rain, fog, mist or the like. As a result, much importance has been attached to the withstanding voltage characteristics under a contaminated condition of an insulator in designing electric power equipment. The withstand voltage under a contaminated condition of a rod-type insulator is affected considerably by the leakage distance along the insulator surface and it is well known in the art that the withstand voltage under a contaminated condition can be increased by several structural modifications including increasing the height of the insulator, increasing the number of sheds without changing the height of the insulator, increasing the number of ribs or providing the trunk portion with ribs so as to increase the leakage distance along the insulator surface. However, to increase the height of the insulator is disadvantageous from the standpoints of mechanical designing and economics since it increases the size of the instrument as a whole. Increasing the leakage distance along the surface by simply increasing the number of sheds or the number of ribs or corrugations without changing the height of the insulator cannot proportionately increase the withstand voltage under contaminated condition, and the withstand voltage is greatly affected by the shape of the insulator sheds including the shed pitch and other conditions. This shed shape is the most important factor that must be considered particularly in anti-contamination design of insulators and bushing shells having a long leakage distance. Thus, a prior art rod-type insulator of the type shown in FIG. 4 of the accompanying drawings has been designed which takes into consideration the ratio of the leakage distance L per shed 2 to the shed pitch P of an insulator body 1 or L/P. With this prior art insulator, however, no consideration has been given to the maximum possible inter-shed coefficient which will be defined as l/p, where p represents the distance between the adjoining insulator sheds, i.e., the distance between a given point B on the lower surface of one shed 2 and another given point C on the upper surface of the other opposing shed 2 and l represents the leakage distance between the given points B and C along the insulator surface. A phenomenon has been observed in these prior art insulators in which an arc bridges across a rib or corrugation 3 on the lower surface of one shed 2 and the upper surface of the other opposing shed 2. This arcing occurs because the inter-sheds coefficient is too large thus preventing effective functioning of the leakage distance L of that portion. As a result, if the leakage distance L of the insulator is simply increased, the withstand voltage under a contaminated condition cannot be increased correspondingly. Where the length of the insulator is fixed there exists from the standpoint of insulator design a long felt need for the determination of a shed shape which ensures an excellent insulator with the highest possible withstand voltage under a contaminated condition.

SUMMARY OF THE INVENTION

With a view to meeting these requirements, it is the object of the present invention to provide a rod-type insulator in which the ratio of the leakage distance L per shed to the shed pitch P is selected between 3.8 and 5.0, preferably between 4.0 and 4.6 and the inter-shed coefficient l/p is selected between 4.5 and 6.0, preferably between 4.7 and 5.6.

DESCRIPTION OF THE PREFERRED EMBODIMENT

Figure 1:
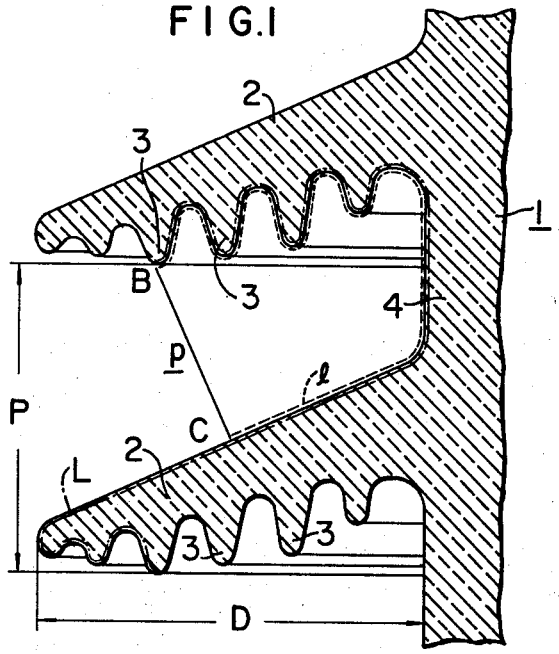
FIG. 1 is a schematic cutaway front view showing an embodiment of the present invention.
Figure 2:
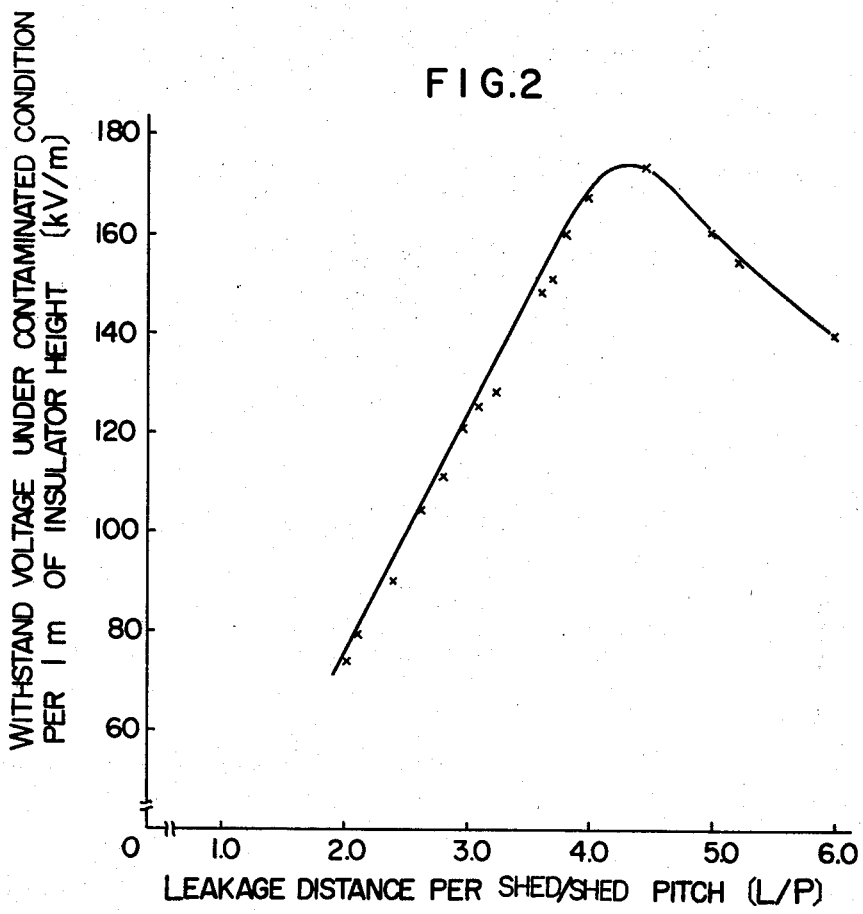
FIG. 2 is a graph showing a withstand voltage characteristic under a contaminated condition in relation to the ratio of the leakage distance per shed to the shed pitch.
Figure 3:
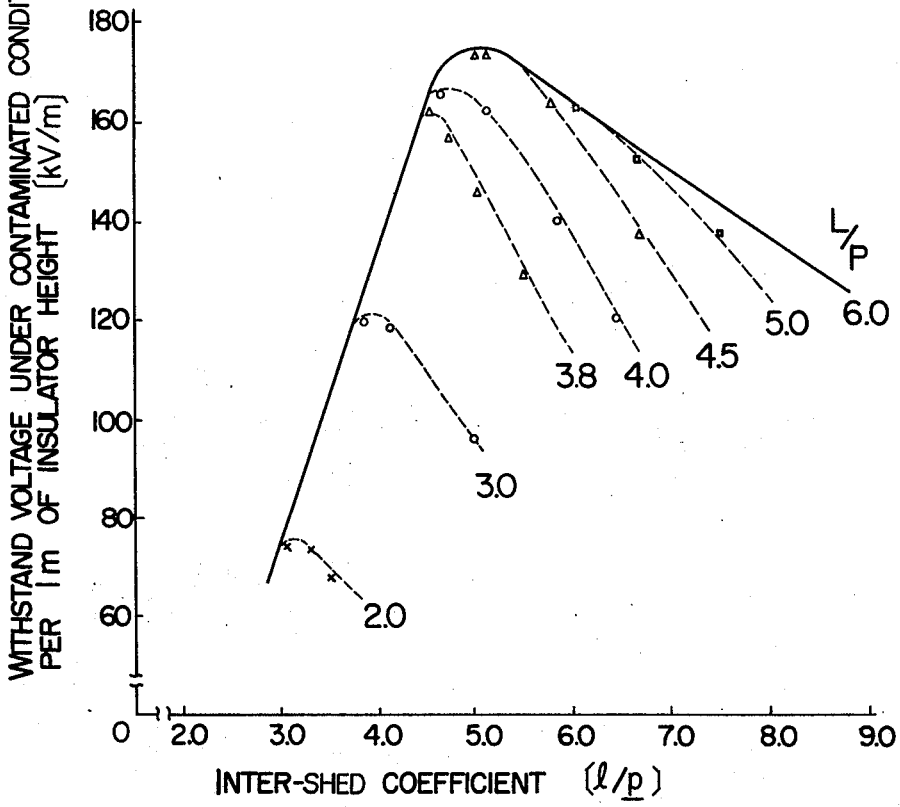
FIG. 3 is a graph showing the relationship between the inter-shed coefficient and the withstand voltage characteristics under a contaminated condition.

Referring now to FIG. 1 illustrating the schematic cutaway front view of a rod-type insulator showing an embodiment of the present invention, reference numeral 1 designates an insulator body, 2 sheds, 3 ribs having substantially rounded tips of substantially the same radii of curvature on the lower surface of the sheds, 4 an insulator trunk, L the leakage distance per shed (shown by the dot-and-dash line), and P the shed pitch. Symbols p and l designate factors which are taken into consideration with the present invention, that is, p represents the distance between the adjoining sheds, i.e., the distance between a point B optionally given on the lower surface of one (upper) shed 2 and another point C optionally give on the upper surface of the other opposed (lower) shed 2, and l represents the leakage distance between these given points B and C along the insulator surface (shown by the broken line). In accordance with the present invention, as will be seen from the below-mentioned experimental results, an effectively improved withstand voltage characteristics under contaminated condition will be ensured for a rod-type insulator in which the ratio L/P is selected $3.8 \leqq L/P \leqq 5.0$ and the inter-shed coefficient defined as l/p is selected $4.5 \leqq l/p \leqq 6.0$. Referring to FIG. 2 showing the relationship between the withstand voltage under a contaminated condition and the variation in the ratio of the leakage distance L to the shed pitch P or L/P of insulators of different shed shapes, in accordance with the experimental results shows that the maximum withstand voltage under contaminated condition is obtained when $3.8 \leqq L/P \leqq 5.0$, preferably $4.0 \leqq L/P \leqq 4.6$ and that the withstand voltage under a contaminated condition is extremely low when the value of L/P is less than 3.8 or greater than 5.0. In designing the shed shape the optimum conditions are sought in relation to the shed pitch P instead of simply increasing the leakage distance L. In addition, from FIG. 3 in which the relationship between the inter-shed coefficient and the withstand voltage under a contaminated condition is shown by the dotted lines with respect to several fixed values of the ratio of the leakage distance L to the shed pitch P or L/P, it will be seen that the envelope connecting the maximum withstand voltages under contaminated a condition for the respective values of L/P takes the form of the curve shown by the solid line. Thus the maximum withstand voltage under a contaminated condition is obtained when the inter-shed coefficient l/p is selected $4.5 \leqq l/p \leqq 6.0$, preferably $4.7 \leqq l/p \leqq 5.6$ and that the withstand voltage under a contaminated condition is extremely low when the value of l/p is less than 4.5 or greater than 6.0. In accordance with the present invention, these two requirements are satisfied with the result that with the height of the insulator fixed, the surface leakage distance L of the insulator can be increased within the effective range of function and consequently the withstand voltage characteristics of the insulator under a contaminated condition can be improved remarkably. FIGS. 2 and 3 show the withstand voltages under contaminated condition of 0.03 mg/cm$^2$.

Figure 4:
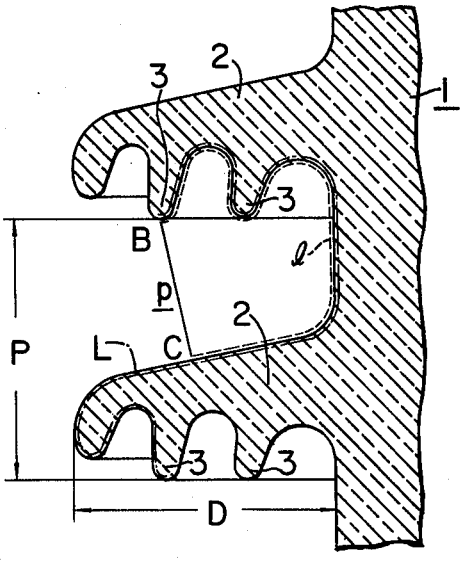
FIG.4 PRIOR ART
FIG. 4 is a schematic cutaway front view showing an exemplary form of the prior art rod-type insulators.
Figure 5:
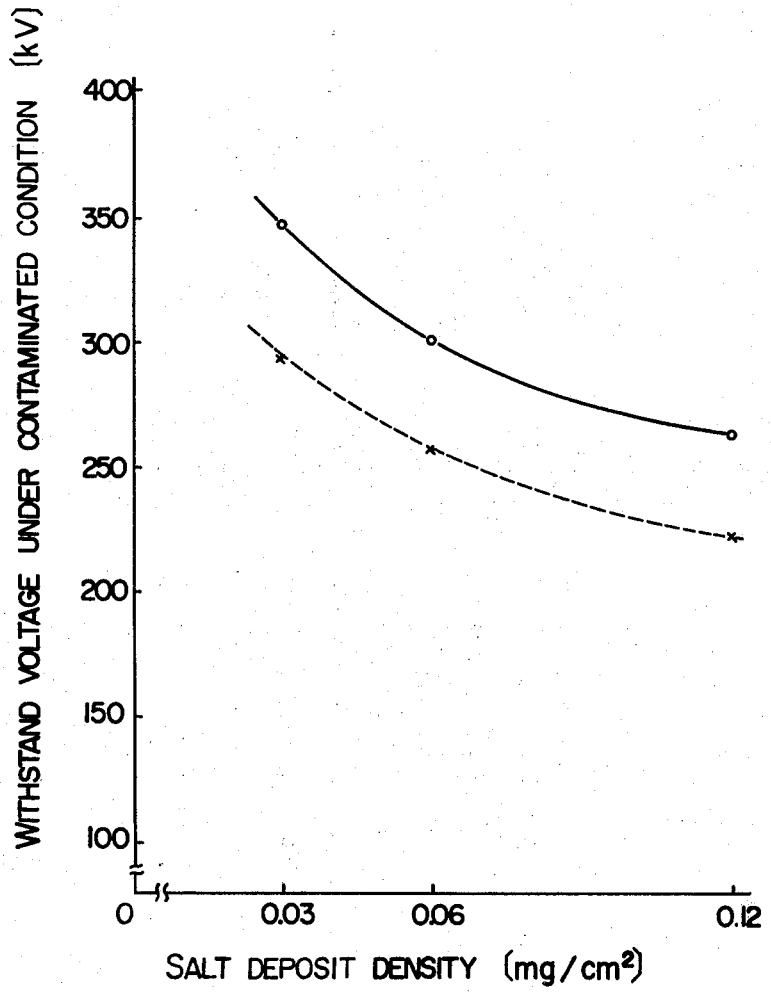
FIG. 5 is a graph showing comparatively the relationship between the salt deposit density and the withstand voltage of the rod-type insulator of this invention and the prior art rod-type insulator.

An embodiment of the present invention showing more specific dimensions will now be described with reference to FIG. 1, in which the insulator body 1 includes a plurality of sheds 2 which are arranged at desired intervals on the periphery of the trunk portion 4 to project therefrom, and each of the sheds 2 is formed in the lower surface with a plurality of ribs 3. The insulator body 1 is so designed that the height of the insulator is selected as 2,000 mm, the length D from the outer edge of the shed 2 to the trunk is 120 mm, the leakage distance L per shed 2 is 410 mm and the shed pitch P is 92 mm thus giving the ratio of the leakage distance L per shed 2 to the shed pitch P or L/P of 4.5, and that the distance p between the adjoining sheds 2 or the distance between a given point B on the lower surface of one shed 2 and another given point C on the upper surface of the other opposing shed 2 is selected as 58 mm and the length l between the points B and C along the insulator surface is 290 mm thus giving the maximum possible inter-shed coefficient of 5.0. FIG. 5 shows by the solid line the relation between the salt deposit density and the withstand voltage of such a rod-type insulator. FIG. 4 shows an exemplary form of the prior art rod-type insulators, and the component parts corresponding to those of FIG. 1 are designated by like reference numerals. Assuming that the prior art insulator is designed so that the height of the insulator is selected as 2,000 mm, the length D from the outer edge of the shed 2 to the trunk portion 4 is 65 mm, the leakage distance L per shed 2 is 234 mm, the shed pitch P is 65 mm, the distance p between the adjoining sheds 2, i.e., the distance between a given point B on the lower surface of one shed 2 and another give point C on the upper surface of the other opposing shed 2 is 36 mm and the length l between the points B and C along the insulator surface is 155 mm. Then the resulting ratio of the leakage distance L per shed 2 to the shed pitch P or L/P is 3.6 and the resulting inter-shed coefficient l/p is 4.3. A comparison between this prior art insulator and the insulator of this invention having the dimensions shown in FIG. 1 is indicated by the dotted line in FIG. 5. The relationship between the salt deposit density and the withstand voltage under a contaminated condition for the insulator of this invention is improved by about 20% thus remarkably improving the withstand voltage characteristics under contaminated condition over the prior art insulator. While, in the embodiment described above, the body portion 4 is provided with no ribs, similar effects can of course be ensured for a rod-type insulator of the type having such ribs.

As will be seen from the description of the preferred embodiment of the invention, in accordance with the present invention, by virtue of the fact that the ratio of the leakage distance per shed to the shed pitch and the inter-shed coefficient are taken into consideration in the designing of a rod-type insulator a shed shape can be obtained which ensures that with the height of the insulator fixed, the leakage distance can be increased within the effective range with the resulting improvement in the withstand voltage characteristics under a contaminated condition, thus providing a small sized rod-type insulator which prevents the occurrence of any flashover fault and thereby making a very great contribution to the industry concerned.

Various modifications in structure and/or function may be made by one skilled in the art to the disclosed embodiments without departing from the scope of the invention as defined by the claims.

What is claimed is:

1. A rod-type insulator having a body and a plurality of adjoining sheds in an axial direction thereof and projecting from the body with the following relationships:

$$3.8 \leqq L/P \leqq 5.0;\ 4.5 \leqq l/p \leqq 6.0$$

wherein P is the pitch between the adjoining sheds, L is the leakage distance per shed, p is the distance between a given point on a lower surface of one of the adjoining sheds and another given point on an upper surface of the other opposing shed, and l is the leakage distance between the given points and, wherein the lower surface of each shed has coaxial ribs forming an undulating surface.

2. An insulator according to claim 1, wherein the former relationship is $4.0 \leqq L/P \leqq 4.6$.

3. An insulator according to claim 1 or claim 2, wherein the latter relationship is $4.7 \leqq l/p \leqq 5.6$.

4. An insulator according to claim 1 wherein the ribs have substantially rounded tips.

5. An insulator according to claim 4 wherein the tips have substantially the same radii of curvature.

6. An insulator according to claim 1 wherein the ribs extend non-uniformly from the lower surface.

7. An insulator according to claim 1 wherein the projection of the sheds from the body is substantially the same for each shed.

8. An insulator according to claim 1 wherein the sheds have a substantially conical cross-section.

* * * * *